United States Patent [19]

Kranc

[11] 4,211,520

[45] Jul. 8, 1980

[54] TIMING CONTROL FOR SLEEVE METERING FUEL SYSTEM

[75] Inventor: Stanley J. Kranc, Morton, Ill.

[73] Assignee: Caterpillar Tractor Co., Peoria, Ill.

[21] Appl. No.: 871,053

[22] Filed: Jan. 20, 1978

[51] Int. Cl.[2] ..... F02M 59/28

[52] U.S. Cl. ..... 417/494; 123/500

[58] Field of Search ..... 417/494, 499; 123/139 AE, 139 AR, 130 BD

[56] References Cited

U.S. PATENT DOCUMENTS

| | | | |
|---|---|---|---|
| 1,740,360 | 12/1929 | L'Orange | 123/139 AE |
| 1,951,215 | 3/1934 | Sidney | 417/494 |
| 1,958,948 | 5/1934 | Knecht | 417/499 |
| 2,147,390 | 2/1939 | Vaudet | 123/139 AE |
| 3,385,221 | 5/1968 | Parks | 417/494 |
| 3,472,215 | 10/1969 | Maxwell et al. | 123/140 R |
| 3,712,763 | 1/1973 | Parks | 417/499 |

FOREIGN PATENT DOCUMENTS

| | | | |
|---|---|---|---|
| 403598 | 12/1933 | United Kingdom | 123/139 AR |
| 1395384 | 5/1975 | United Kingdom | 123/140 R |

*Primary Examiner*—Leonard E. Smith

*Attorney, Agent, or Firm*—Phillips, Moore, Weissenberger, Lempio & Majestic

[57] ABSTRACT

The invention relates to an improvement in an engine fuel pump having a fill port in a plunger closed and opened during plunger strokes by a face of a relatively stationary barrel surrounding the plunger. A spill port in the plunger is closed and opened during plunger strokes by a relatively stationary collar surrounding the plunger and a linkage structure is operable by a governor or the like for adjusting the collar axially on the plunger to vary the separation of the barrel face from the collar and thereby the volume of fuel delivered per plunger stroke. The improvement of the invention comprises an oblique surface serving as the barrel face along with apparatus for adjustably setting the angular position of the plunger about its axes and thereby adjusting injection timing.

18 Claims, 7 Drawing Figures

TIMING CONTROL FOR SLEEVE METERING FUEL SYSTEM

BACKGROUND OF THE INVENTION

1. Field of the Invention

The invention is concerned with multi-plunger engine fuel pumps of the sleeve metering variety and more particularly is concerned with improvements in such pumps which allow the timing thereof to be automatically adjusted responsive to engine load or the like.

2. Prior Art

Fuel injection systems for diesel engines and the like require precise injection timing control, particularly for minimizing engine emissions. Sleeve metering fuel systems can be advantageously employed with diesel engines but usually these have only been equipped with a speed-sensitive injection timing control. The adaptation of known means of load sensitive timing control to sleeve metering systems generally requires complex and space using structural members. Hence, sleeve metering fuel systems have not, previously to the present invention, been readily adaptable to load-sensitive timing control.

It would be highly desirable to provide a sleeve metering fuel system useful with diesel engines and the like and which would include a useful, simple, compact and relatively easy to construct and install load-sensitive timing control. With such an improvement the advantages of a sleeve metering fuel system can be realized while the aforementioned disadvantages of complexity and bulk of conventional load-sensitive timing controls is eliminated.

SUMMARY OF THE INVENTION

The present invention is directed to overcoming one or more of the problems as set forth above.

The invention is concerned with an improvement in an engine fuel pump having a fill port in a plunger closed and opened during plunger strokes by a face of a relatively stationary barrel surrounding the plunger, a spill port in said plunger closed and opened during plunger strokes by a relatively stationary collar surrounding the plunger and linkage means operable by a governor or the like for adjusting the collar axially on the plunger to vary the separation of the barrel face from the collar and thereby the volume of fuel delivered per plunger stroke. The improvement of the present invention comprises an oblique surface (any surface not perpendicular to the plunger) serving as said barrel face and means for adjustably setting the angular position of said plunger about its axes.

BRIEF DESCRIPTION OF THE DRAWINGS

The invention will be better understood by reference to the figures of the drawings wherein like numbers denote like parts throughout and wherein.

DETAILED DESCRIPTION OF THE PREFERRED EMBODIMENTS

Figure 1:
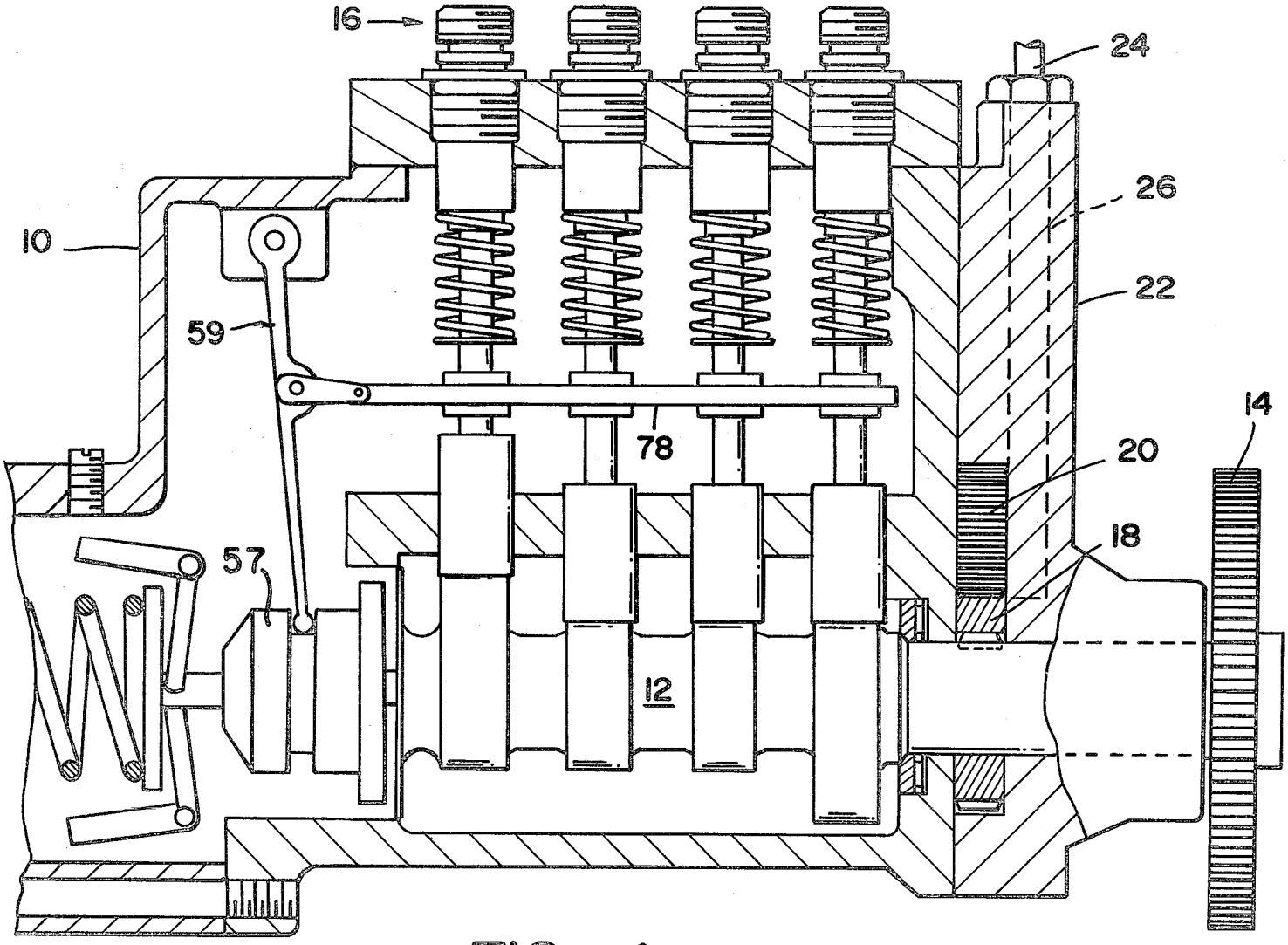
FIG. 1 illustrates in longitudinal vertical section a view through a pump housing showing pumps and controls therefor embodying the present invention.
Figure 2:
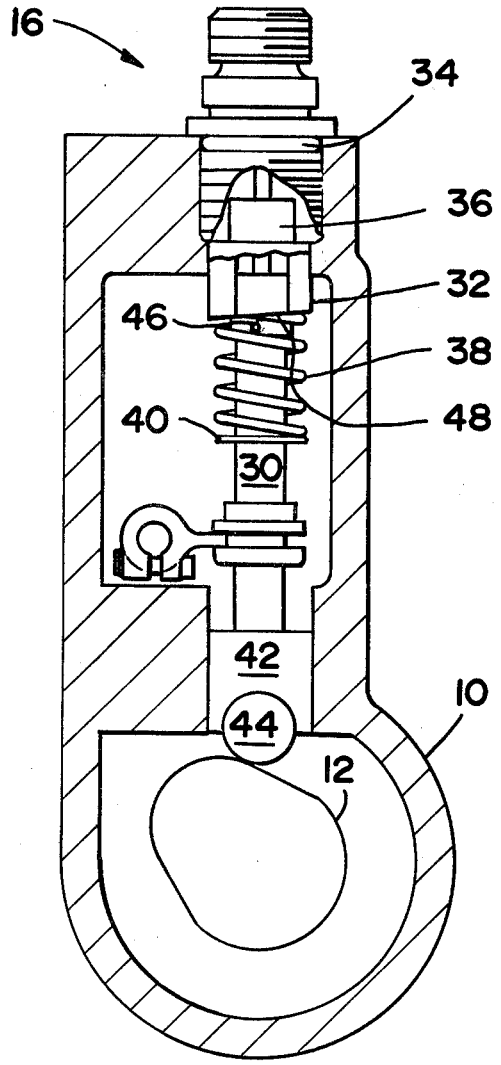
FIG. 2 is a sectional view taken on line II—II of FIG. 1.
Figure 7:
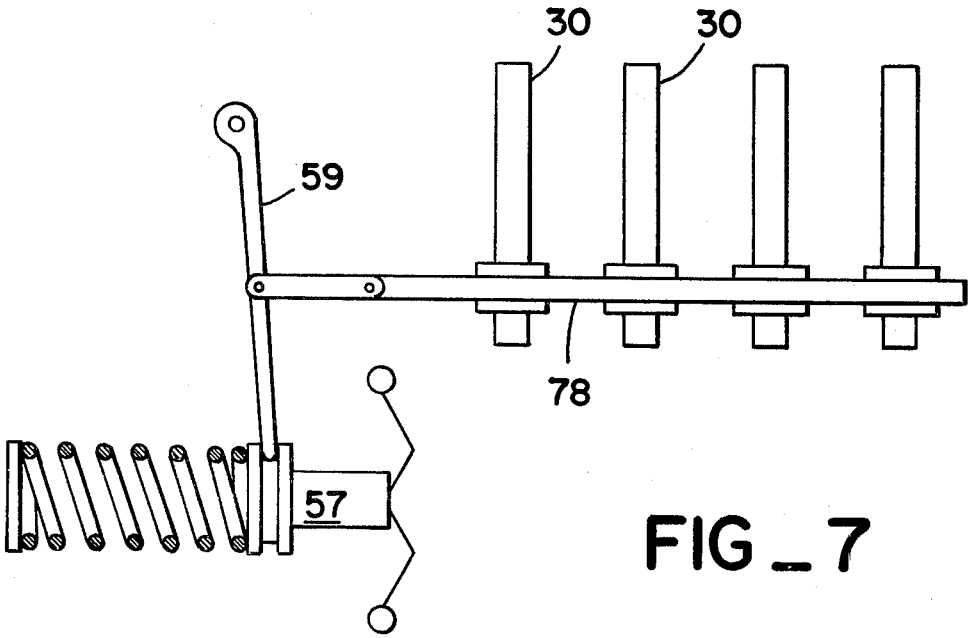
FIG. 7 illustrates schematically means for engine load responsive operation of the improvement of the present invention.

Adverting first to FIGS. 1 and 2, a pump housing 10 is shown as journaling a camshaft 12 driven by a gear 14 which may be part of an engine timing gear train, not shown. The camshaft 12 drives the plungers of a plurality of identical fuel oil pumps such as generally indicated at 16. In the case illustrated, there is a single line of pumps with four pumps for delivering fuel in timed sequence as determined by the single camshaft to cylinders of a four cylinder engine. The principle of the present invention will, however, apply to a double line of pumps, for an engine of any number of cylinders, and to other fuel pump configurations as will to be apparent upon reading the ensuing description.

The pumps and moving part within the housing are immersed in fuel oil which is delivered to the housing by an engine driven transfer pump. In the embodiment illustrated, the transfer pump comprises two pump gears 18 and 20 shown in FIG. 1 with the driving gear 18 keyed to the camshaft 12 and both gears housed in an auxiliary sidewall or cover plate 22 of the pump housing 10. Fuel from a source of supply not shown enters through a conduit 24 and passage 26 where it is delivered by the pump gears via a passage, not shown, which enters the pump housing 10.

The construction of the several pumps which are identical is best shown by the pump illustrated in cross-section in FIG. 2. A pump plunger 30 is reciprocal within a relatively stationary barrel 32 sealably abutted or otherwise suitably secured to a bonnet 34 which is retained in an opening in the pump housing and adapted for communication with the combustion chamber of an engine cylinder. A spring check valve 36 in the bonnet closes the pump barrel and is opened to admit oil to the combustion chamber only when pressure in the barrel attains a predetermined level. A spring 38 urges the plunger toward retraction from the barrel. The spring 38 is disposed between the barrel and a spring seat 40. The lower end of the plunger seats in a cam follower comprising an apron portion 42 slidable in a suitable bore formed by the pump housing and carrying an anti-friction roller 44 for engagement with a cam surface on the camshaft 12. When the plunger is retracted or in the partially retracted position shown in FIG. 2, fuel under moderate pressure from the fuel pump is admitted from within the housing 10 through a fill port 46 (See FIG. 3) in the plunger 30 so that upon rotation of the cam and advancement of the plunger into the barrel, the fill port 46 is closed trapping and compressing the fluid in the chamber above the plunger until the check valve opens and fluid is directed to the engine.

Figure 3:
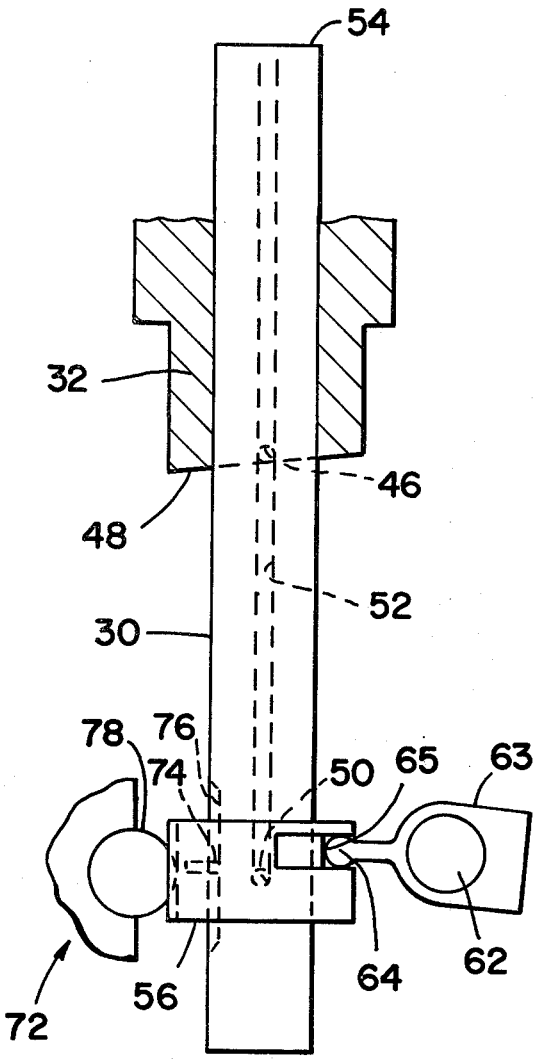
FIG. 3 is a side view in section illustrating an improvement in accordance with one embodiment of the present invention.
Figure 4:
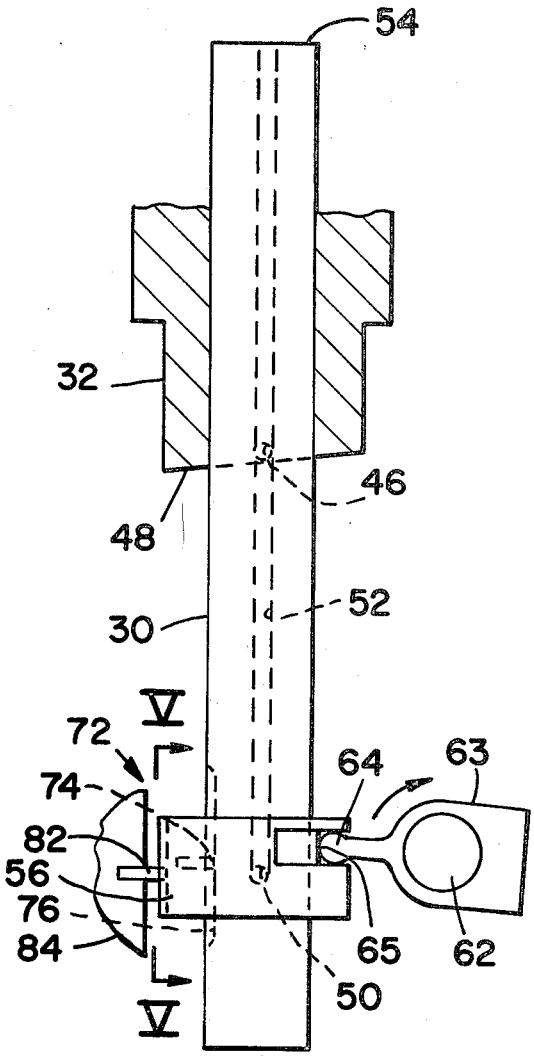
FIG. 4 is a view similar to FIG. 3 illustrating an alternate embodiment of the present invention.

In accordance with the present invention, the timing of injection is determined by the angle of an oblique face 48 of the barrel 32 and by the rotational position of the plunger 30 about its axis as will perhaps be most apparent from FIGS. 3 and 4. As the plunger 30 is rotated about its axis relative to the barrel 32, the fill port 46 will open earlier or later due to the oblique angle of the face 48. In this manner the timing of injection is controlled. When the term "oblique" is used herein it is used broadly to indicate a face 48 which is other than perpendicular to the plunger 30. Volume of fluid delivered per plunger stroke is controlled by a spill port 50 extending transversely through the plunger 30 as indicated by dotted lines in FIGS. 3 and 4 and which communicates with a longitudinal passage 52 which extends through a head end 54 of the plunger 30. A collar 56 surrounds the plunger 30 and closes the spill port 50 during the effective stroke. However, upon upward movement of the plunger 30 to the position where the spill port 50 is uncovered, pressure at the head end 54 of the plunger 30 is vented via the passage 52 and spill port 50 into the housing and the check valve 36 closes. This concludes the delivery of fluid to the combustion chamber and determines the volume delivered per stroke so that adjustment of the collar 56 longitudinally relative to the plunger 30 determines the volume of fuel delivered per stroke.

This adjustment may be accomplished manually or automatically in response to engine requirements as sensed by an engine governor. A rectilinearly movable conventional engine governor element is illustrated at 57 in FIGS. 1 and 7. Briefly and as is seen more clearly in FIG. 7, the engine governor element 57 moves in response to demands for additional fuel and in doing so motivates a lever 59 which has an end 60 engaged against the engine governor element 57. The lever 59 is secured to a shaft 62, which is shown in FIGS. 1, 3, 4 and 7 and the shaft 62 can carry control pins or links 63 (FIGS. 3 and 4) extending through and rotatable with respect to the shafts. Each link has a ball like end 64 eccentrically positioned with respect to the axis of the link so that adjustment of the link by rotation thereof varies the position of the end 64 in a direction lengthwise of the plunger 30. The ball like ends 64 of the links 63 are received in sliding fit within notches 65 which extend a significant distance about the circumferences of the collars 56 so that oscillation of the pins 63 with their supporting shafts 62 slides the collars longitudinally relative to the plungers 30 and varies the time at which the spill ports 50 are opened. For example, when the engine governor 57 moves the shafts 62 are rocked in directions to move the pins 63 and slide the collars 56 upwardly or downwardly dependent upon the direction of motion of the governor 57. Thus a differing advancement of the plungers into the pump barrel is required before the spill ports 50 are opened and injection is discontinued.

As will be clear from FIG. 1 the adjustment of the links 63 enables the attainment of equal volume delivery by each of the several pump plungers. Upon rotation of the links 63, the effective positions of the ends 64 can be adjusted to slightly vary the time of opening of the spill port 50, and each link may be fixed in its adjusted position.

Referring now most particularly to the improvement of the present invention, it is noted that this comprises a combination of the oblique face 48 on the lower end of the barrel 32 with means for simultaneously adjustably setting the angular positions of each of the plungers 30 about their cylindrical axes. As is illustrated in FIG. 3 an adjustable angular position setting means 72 can comprise in one embodiment of the invention motivating means such as a post 74 which may be in the form of a pin carried by each of the collars 56 and motivated means such as a longitudinal slot 76 carried by each of the plungers 30 and engaged with the respective one of the posts 74. The adjustable angular position setting means 72 will then also include means for adjustably rotating each of the collars 56 about its respective axis. In the embodiment illustrated in FIG. 3 the particular means shown for adjustably rotating the collars 56 about their cylindrical axes comprises a rack 78 which engages with an outer cylindrical surface of the collar 56. It is clear that as the rack 78 causes the collar 56 to rotate, the post 74 which proceeds inwardly from the inner surface of the collar 56 acts upon the slot 76 and thus forces the plunger 30 to rotate. As a result of this rotation the fill port 46 will be shut off during stroking of the plunger 30 either earlier or later depending on the direction of rotation of the plunger 30. That is, the oblique face 48 will cut out flow into the fill port 46 either earlier or later during the stroke cycle. The positioning of the rack 78 can be made responsive to changes in engine load, for example changes in fuel consumption if this is desired. This can be accomplished by conventionally linking the axial movement of the rack 78 to the rotary motion of the control shaft 62, or, somewhat more directly and simply to the axial motion of the governor element 57. Alternatively, the rack 78 may be made to adjust responsively to changes in engine speed or to combinations of changes in engine load and engine speed. In this manner automatic adjustment of injection timing can be provided in response to one or more of these signals.

Alternate Embodiment

Figure 6:
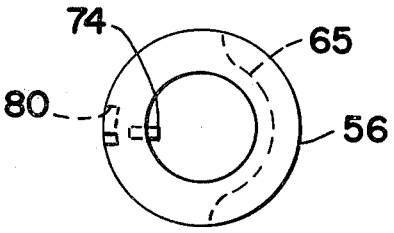
FIG. 6 is a view illustrating a detail in the embodiment of FIG. 4.
Figure 5:
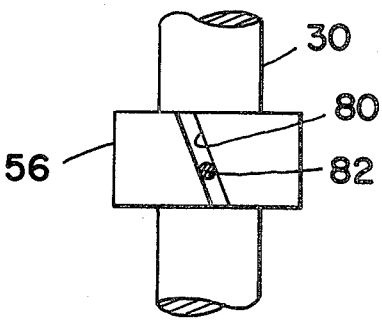
FIG. 5 is a view taken on line V—V of FIG. 4.

Referring now to FIGS. 4, 5 and 6 there is illustrated an alternate embodiment of the present invention which has certain features which make this embodiment a preferred design.

The differences between the embodiment of FIGS. 4–6 and the previously described embodiment lies solely in the particular adjustable angular position setting means 72. In particular, the adjustable angular position setting means 72 of the embodiment of FIGS. 4–6 operates directly responsively to rotational movement of the link 63. As with the previously described improvement, a post 74 extends inwardly radially from the inner surface of the collar 56 and is held in a longitudinally extending slot 76 formed in the plunger 30. A curved slot 80 of an oblique or helical nature is formed in the outer surface of the collar 56 as is seen most clearly in FIG. 5. Slot engaging means, in the embodiment illustrated in FIGS. 4–6 a post 82, is provided extending from a stationary support illustrated schematically by 84. The post 82 fits slidingly within the curved slot 80. As the metering control shaft 62 rotates e.g., conventionally motivated and responsive to engine speed and/or load, in a direction shown by the arrow in FIG. 4 this moves the collar 56 upwardly. As the collar 56 moves upwardly it is forced to rotate by the action of the post 82 upon the curved slot 80. This in turn causes the plunger 30 to rotate by the action of the post 74 upon the longitudinally extending slot 76. Meanwhile, the ball like end 64 of the link 63 slides within the notch 65, which as will be most particularly noted from FIG. 6 extends a significant distance about the circumference of the collar 56. As with the previously described embodiment the time of closing of the fill port 46 is varied due to the rotation of the spill port 46 relative to the oblique face 48 of the barrel 32.

Thus, in the embodiment of FIGS. 4–6 automatic rotation of the plunger 30 occurs which causes the fill port 46 to close earlier or later, causing injection timing to occur earlier or later. Further, this function is linked to or otherwise coordinated with the axial motion of the collars 56. The axial position of the collars 56 determines the duration of injection (proportionally to fuel consumption or engine load) and, thus, the axial motion of the collar 56 causes rotation of the plunger 30 to vary the injection timing as a function of engine load.

It will be apparent that the post 82 and curved slot 80 can be replaced with other equivalent cam follower and cam means. Hence, the collar rotating means can comprise cam means such as the curved slot 80 on a respective one of the outer cylindrical surface of each of the collars 56 and the stationary frame means (such as the support 84) thereadjacent. The cam follower means such as the post 82 can be on a respective other of the outer cylindrical surface of the collars 56 and the stationary means (such as the support 84). Such cam means and cam follower means provide that the collars 56 each rotate as they are moved axially by linkage means, in the embodiment illustrated by the links 63 under the rotating impetus of the bearing control shaft 62.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The embodiments of the invention in which an exclusive property or privilege is claimed are defined as follows:

1. In an engine fuel pump having a fill port in a plunger closed and opened during plunger strokes by a face of a relatively stationary barrel surrounding the plunger, a spill port in said plunger closed and opened during plunger strokes by a relatively stationary collar surrounding the plunger and linkage means operable by a governor or the like for adjusting the collar axially on said plunger to vary the separation of the barrel face from the collar and thereby the volume of fuel delivered per plunger stroke, an improvement comprising:

an oblique surface serving as said barrel face; and means for engaging said collar and plunger for adjustably setting the angular position of said plunger about its cylindrical axis to adjust injection timing of said fuel pump.

2. In an engine fuel pump having a fill port in a plunger closed and opened during plunger strokes by a face of a relatively stationary barrel surrounding the plunger, a spill port in said plunger closed and opened during plunger strokes by a relatively stationary collar surrounding the plunger and linkage means operable by a governor or the like for adjusting the collar axially on said plunger to vary the separation of the barrel face from the collar and thereby the volume of fuel delivered per plunger stroke, an improvement comprising:

an oblique surface serving as said barrel face: and means for adjustably setting the angular position of said plunger about its cylindrical axes, wherein said adjustable angular position setting means comprises a motivating means carried by said collar and a motivated means carried by said plunger and engaged with said motivating means.

3. An improvement as in claim 2, wherein said motivating means comprises post means and said motivated means comprises slot means.

4. An improvement as in claim 3, wherein said slot means extends longitudinally along outer cylindrical surface of said plunger.

5. An improvement as in claim 2, wherein said fuel pump is one of a plurality of fuel pumps of a multicylinder engine, said adjustable setting means simultaneously adjustably sets the angular positions of each of the plungers of said plurality of fuel pumps about their cylindrical axes, said motivating means are carried by each of the respective collars and said motivated means are carried by each of said plungers and engaged with the respective motivating means.

6. An improvement as in claim 5, including means for motivating said adjustable angular position setting means responsive to changes in engine load.

7. An improvement as in claim 6, wherein said adjustable angular position setting means further comprises:

means for adjustably rotating said collars about their axes.

8. An improvement as in claim 7, wherein said collar rotating means comprises rack means engaged with outer cylindrical surfaces of said collars.

9. An improvement as in claim 8, wherein said motivating means comprises post means and said motivated means comprises slot means.

10. An improvement as in claim 9, wherein said slot means extends longitudinally along outer cylindrical surfaces of said plungers.

11. An improvement as in claim 2, wherein said adjustable angular position setting means further comprises:

means for adjustably rotating said collars about their axes.

12. An improvement as in claim 11, wherein said collar rotating means comprises rack means engaged with outer cylindrical surfaces of said collars.

13. An improvement as in claim 12, wherein said motivating means comprises post means and said motivated means comprises slot means.

14. An improvement as in claim 13, wherein said slot means extends longitudinally along outer cylindrical surfaces of said plungers.

15. An improvement as in claim 11, wherein said collar rotating means comprises cam means on a respective one of the outer cylindrical surfaces of each of said collars and stationary means thereadjacent and cam follower means on a respective other of said outer cylindrical surfaces of said collars and said stationary means, said collars each rotating as they are moved axially by said linkage means due to the interaction of said cam means and said cam follower means.

16. An improvement as in claim 15, wherein said cam means comprise oblique slots and said cam follower means comprise cam post means.

17. An improvement as in claim 16, wherein said motivating means comprises post means and said motivated means comprises slot means.

18. An improvement as in claim 17, wherein said slot means extends longitudinally along outer cylindrical surfaces of said plungers.

* * * * *